US005623771A

United States Patent [19]

Winheim

[11] Patent Number: 5,623,771

[45] Date of Patent: Apr. 29, 1997

[54] STEAM MOISTENING APPARATUS

[75] Inventor: Stefan Winheim, Frankfurt, Germany

[73] Assignee: V.I.B. Apparatebau GmbH, Maintal, Germany

[21] Appl. No.: 582,453

[22] Filed: Jan. 3, 1996

[30] Foreign Application Priority Data

Jan. 12, 1995 [DE] Germany ..... 195 00 752.2

[51] Int. Cl.[6] ..... C26B 17/00

[52] U.S. Cl. ..... 34/585; 34/632; 34/633; 34/638

[58] Field of Search ..... 34/230, 576, 582, 34/585, 629, 632, 633, 638; 162/290, 297, 299

[56] References Cited

U.S. PATENT DOCUMENTS

| | | | |
|---|---|---|---|
| 3,097,994 | 7/1963 | Dickens et al. | 162/290 |
| 3,850,792 | 11/1974 | Pennington | 162/297 |
| 5,079,855 | 1/1992 | Carrier | 34/230 X |
| 5,282,323 | 2/1994 | Winheim | 34/629 |

FOREIGN PATENT DOCUMENTS

| | | |
|---|---|---|
| 4125062 | 2/1993 | Germany . |
| 4309076 | 9/1994 | Germany . |
| 9114045 | 9/1991 | WIPO . |

OTHER PUBLICATIONS

Thesis, A. Haerter, 1961, pp. 70–75, Zurich, Switzerland.

*Primary Examiner*—John M. Sollecito
*Assistant Examiner*—Steve Gravini
*Attorney, Agent, or Firm*—Friedrich Kueffner

[57] ABSTRACT

A steam moistening apparatus includes a housing with a steam connection, wherein a steam blow chamber is arranged in the housing. The steam blow chamber has an external wall in common with the housing and the external wall is provided with steam outlet openings. A distribution duct to which steam can be admitted and which is continuously surrounded by steam on all sides is arranged in the interior of the housing of the steam moistening apparatus. The distribution duct is in communication with the steam blow chamber through several supply lines which are distributed over the length of the housing.

16 Claims, 3 Drawing Sheets

STEAM MOISTENING APPARATUS

BACKGROUND OF THE INVENTION

1. Field of the Invention

The present invention relates to a steam moistening apparatus with a housing which includes a steam connection and in which a steam blow chamber is arranged, wherein the steam blow chamber has an external wall in common with the housing and the external wall is provided with steam outlet openings.

2. Description of the Related Art

Steam moistening apparatus of this type have the purpose of directing steam against material webs travelling past the apparatus in order to increase the moisture and temperature of the material webs. A widespread field of use is the manufacture or processing of paper webs in which such steam moistening apparatus are used in connection with calendars or other roll arrangements. In these arrangements, steam is directed against the paper web before the paper web travels through a roll gap, in order to improve the gloss or the smoothness, to change the bulk or the density or to increase the moisture.

A steam moistening apparatus known from DE 43 09 076 A1, constructed as a steam spray pipe, includes a steam blow chamber which is divided into several sections or zones in transverse direction, i.e, over the width extending in the direction of a material web travelling past the apparatus. Each zone has a valve which permits steam to flow from the interior of the housing into the steam blow chamber in each zone. An acceleration duct is arranged between the valve and the steam blow chamber, wherein a supply duct branches off from the steam blow chamber at a predetermined distance from the end of the acceleration duct.

Another steam moistening apparatus known from DE 41 25 062A1, constructed as a steam blow box, includes a steam blow chamber which is also divided into zones in transverse direction, wherein each zone has its own valve for admitting steam into the steam blow chamber. The steam entering the steam blow chamber had first been used for heating at least one of the walls of the steam blow chamber. Before the steam is used, it is dried in a steam drying section.

Steam moistening apparatus of this type have the advantage that the discharged steam quantity can be adjusted differently at least from zone to zone transversely of the machine direction. However, the apparatus have the disadvantage that they are complicated and, thus, expensive because of the large number of valves of the moistening apparatus. If a single moistening apparatus is not sufficient for directing steam against a side of the material web, for example, when operated at the limit of its capacity, frequently two or more moistening apparatus are used. However, in that case, it is no longer necessary to equip all moistening apparatus with separate controllable zones. Rather, it is sufficient when it is possible to change the total quantity of steam discharged by the steam moistening apparatus. It is then possible to achieve a uniform discharge of steam in transverse direction of the machine, i.e., transversely of the travelling material web, by means of a single steam moistening apparatus which can be controlled zone by zone.

SUMMARY OF THE INVENTION

Therefore, it is the primary object of the present invention to provide a steam moistening apparatus of the above-described type which can be reliably operated without a zone-by-zone control.

In accordance with the present invention, in the interior of the housing of the steam moistening apparatus of the above-described type, is arranged a distribution duct to which steam can be admitted and which is continuously surrounded by steam on all sides, wherein the distribution duct is in communication with the steam blow chamber through several supply lines which are distributed over the length of the housing.

The distribution duct is arranged essentially parallel to the steam blow chamber. Of course, the definition of having the distribution duct surrounded on all sides by steam still permits interruptions of the steam surroundings, as they may be required, for example, by a fastening means of the distribution duct in the housing. The distribution duct is continuously heated, i.e., also when operation of the apparatus is interrupted. After shutdowns, i.e., when the steam moistening apparatus is also switched off, an initial heating phase is required during which the distribution duct is continuously surrounded by steam before steam can be admitted to the material web from the steam moistening apparatus.

The configuration of the steam moistening apparatus according to the present invention makes it possible, on the one hand, to distribute the steam relatively uniformly over the length of the width of the moistening apparatus. This is because the distribution duct ensures that the steam is initially distributed once over the width, i.e., in transverse direction of the machine, before the steam is supplied to the steam blow chamber. Accordingly, each section over the width of the apparatus receives the same quantity of steam under the same pressure. Consequently, by the omission of a zone-by-zone control of the steam blow box, there at least occurs no deterioration of the intended result of the application of steam, i.e., moisture, gloss or smoothness or the like.

However, another positive effect can be achieved by the distribution duct. Contrary to steam blow boxes which are controlled zone-by-zone and in which a valve is arranged at each zone for controlling the supply of steam into the zone, such zone valves are not provided in the steam moistening apparatus according to the present invention. Rather, only one or two valves are provided which control the entire steam supply to the moistening apparatus. Consequently, these valves cannot be located immediately adjacent to the zones.

When the operation is interrupted, as it may occur, for example, when exchanging a roll in a calendar, when changing a material web roll or also in other cases, the necessary heat supply to the steam moistening apparatus is usually no longer ensured. When starting up the apparatus after the interruption, this has the result that the steam which was actually intended for applying steam to the material web initially condenses in the moistening apparatus. The discharge of the condensate is usually no problem, however, as soon as condensate, i.e., water is present in the steam moistening apparatus, there is the danger that the steam flowing through the apparatus entrains water droplets and transports the water droplets onto the material web. Since the steam is to be blown with relatively high speeds against the material web, in order to be able to direct the desired amount of steam against the material web which travels at a high speed, this results in correspondingly high speeds of the water droplets. The water droplets then act as bullets which perforate the material web or damage the material web in some other manner. In accordance with the present invention, this problem has now essentially been eliminated by the configuration of the apparatus with a distribution duct.

Heating of the distribution duct ensures that the steam is raised to the necessary temperature before entering the steam blow chamber. Accordingly, even if the steam still should contain some water, this water is very likely to be vaporized at the latest in the distribution duct. Accordingly, for controlling the steam supply to the steam blow chamber, such a steam moistening apparatus can be equipped with a valve which is spatially removed from the steam moistening apparatus. It is now possible that the supply for the process steam, i.e., the steam which is used for moistening the material web, can cool during production stops; in addition, it is acceptable that the process steam contained in the supply can condense. However, since the distribution duct is continuously heated and maintained at a high temperature, when the apparatus is restarted, the process steam is heated at the latest in the distribution duct to such an extent that the water can vaporize, so that the danger of water droplets damaging the material web is significantly reduced. It is now also possible to operate such apparatus in an upside-down configuration, i.e., with the steam being discharged toward the bottom; in the past, this was not easily possible because water of condensed steam could drop onto the web.

In accordance with a preferred further development of the present invention, the cross-sectional area of the distribution duct is greater than the sum of the cross-sectional areas of all supply lines. This feature makes it possible in a simple manner that the steam is initially uniformly distributed in the distribution duct before it enters the steam blow chamber. By adhering to the stated dimensions, the cross-sectional area of the distribution duct may be uniform over the width of the apparatus, without leading to pressure drops which would impair the supply to the steam blow chamber in certain sections.

In accordance with another preferred feature, at the locations where the supply lines open into the steam blow chamber, the axis of each supply line extends essentially perpendicular to a baffle wall located opposite the supply line. This configuration represents an additional safety measure. Water droplets which have reached the steam blow chamber in spite of all previous measures, are initially reflected back into the entering steam jet in which they are in all likelihood vaporized. Moreover, this configuration provides significant advantages with respect to the reduction of the noise level which is generated when the discharged steam flows toward the material web.

In accordance with another preferred feature, the baffle wall extends essentially at a right angle to the external wall. This means that the water droplets must carry out another change of direction before they can be discharged through the steam outlet openings. However, a certain time is required for this change in direction which leads to an increase in the period of time in which the water droplets are within the steam blow chamber. It is very likely that the water droplets vaporize during this time. It must be emphasized in this connection that the heated distribution duct has already drastically reduced the risk of water droplets reaching the steam blow chamber at all. The additional measures described above are really only intended for rare exceptions.

Another preferred feature provides that the supply lines extend with a predetermined length into the interior of the distribution duct. This means that steam can only be removed from the interior of the distribution duct and not from the wall areas thereof. However, because of their mass, water droplets will predominantly precipitate at the walls of the distribution duct located at the bottom in the direction of gravity, so that it can be assumed that an essentially water-free steam is present in the interior of the distribution duct, i.e., at a distance from the walls of the distribution duct. Moreover, this configuration also makes possible the discharge of steam in a downward direction. In that case, the supply lines extend out of the distribution duct in a downward direction. However, the ends of the supply lines projecting into the interior of the distribution duct ensure that water collecting at the bottom of the distribution duct, i.e., on the bottom wall in the direction of gravity, will not enter the supply lines.

The supply lines preferably have a bend between the supply duct and the steam blow chamber, wherein the bend extends over an angle of approximately 90°. Since the supply lines are also located in the interior of the housing and are surrounded by steam, this measure means a small further extension of the length along which the steam is guided through a heated environment. In addition, the bend makes it possible in a simple manner to produce the desired direction of the steam when entering the steam blow chamber. Moreover, when flowing through the bend, any possibly remaining water is thrown by the centrifugal force against the heated wall of the bend and is vaporized. The bend additionally produces the advantageous effect of noise reduction.

The locations at which the supply lines open into the steam blow chamber are preferably spaced from each other at essentially equal distances. This simple measure produces a relatively uniform supply of steam to the steam blow chamber and the attendant uniform steam discharge in transverse direction of the machine.

In accordance with a particularly preferred feature, the distance between the end of the steam blow chamber and the opening of the next supply line into the steam blow chamber is approximately half the distance between adjacent openings of supply lines. When the steam blow chamber is considered to be divided into zones, each of the supply lines opens approximately in the center of each such zone in this manner, a uniform distribution of the steam can be ensured in a simple manner.

The distribution duct preferably has a steam inlet, wherein the distance of each supply line from the steam inlet is at most half the length of the distribution duct. This measure also contributes to a uniform distribution of the steam in the steam blow chamber. The distance which must be travelled by the steam is kept as short as this is possible with simple means.

In accordance with a particularly preferred embodiment, the housing has a heating steam connection and the distribution duct has a process steam connection which is separate from the heating steam connection. The heating steam connection can be connected permanently to steam supply, so that the interior of the housing is filled with hot steam. This steam serves for heating the distribution duct and also for heating the steam blow chamber which may also be arranged in the interior of the housing. The temperature of the steam can be controlled relatively easily through the pressure at the heating steam connection. The quantity of steam fed into the distribution duct can be controlled through the process steam connection which is provided with a valve for this purpose. This valve no longer has to be arranged in the immediate vicinity of the moistening apparatus. This may be particularly advantageous where the available space is narrow, for example, in material web pockets for deflecting the material web between roll gaps. Rather, a longer supply line is acceptable, even if there is the risk that the steam in the line cools and condenses during interruptions of the production. When the moistening apparatus is started or restarted, this water is transported into the steam moistening apparatus. However, since the latter is heated, particularly in the area of the distribution chamber, the water is essentially vaporized.

In accordance with another preferred feature, the process steam connection has an inlet duct extending within the interior of the housing, wherein the inlet duct is connected to the distribution duct through a connecting duct which ends approximately in the middle of the distribution duct. Consequently, the process steam is heated already immediately after entering the housing; specifically, heating occurs in the inlet duct. This contributes to a further reduction of the problems which might occur when water droplets are entrained in the steam. It must only be ensured that the capacity of the inlet duct is adapted to the quantity of the expected water.

It is particularly advantageous in this connection that the inlet duct is constructed as a steam drying section. The drying of steam can be effected, for example, by increasing the cross section of the inlet duct as compared to the process steam connection. As a result, the flow velocity of the entering steam is reduced and water which enters with the steam in the inlet duct can be precipitated and deposited relatively problem-free on the bottom of the inlet duct.

This effect can be improved in a preferred embodiment by forcing the steam to carry out at least one change of direction in the flow path in the inlet duct. Such a change of direction is carried out without problems by the steam. However, the water droplets which because of their mass have a greater inertia, will initially resist such a change in direction. In other words, the water droplets have the tendency of travelling straight ahead. If, for example, a wall is provided in this direction of movement, the water droplets will be caught by this wall and will flow downwardly. In this manner, water droplets are mechanically removed from the steam.

In accordance with an alternative or additional measure, it may be provided that the connecting duct branches off from the inlet duct essentially at a right angle and at a predetermined distance in front of the end of the inlet duct. This change of direction produced by the connecting duct provides an obstacle for the water droplets. As a result of the inertia of the water droplets, they initially travel straight ahead. Since the inlet duct continues for a small distance following the connection with the connecting duct, the water droplets can continue to travel in this direction. The water droplets are then collected at the end of the inlet duct in a type of pocket and can be discharged from the pocket.

In accordance with another preferred embodiment, the distribution duct has at least one inlet valve whose steam-conducting components are arranged in the interior of the housing, wherein steam travels through the inlet valve from the interior of the housing into the distribution duct. In that case, the process steam, i.e., the steam used for the treatment, of the material web, is taken from the heating steam. However, in this embodiment it is also ensured that the distribution duct is permanently heated by the steam. In that case, steam is present all the way to the steam moistening apparatus even when production is interrupted. This substantially reduces the danger that the water cools and condenses in a supply line. Since the inlet valve is arranged at least with its steam conducting components in the interior of the housing, it is ensured that these components are also permanently heated, so that again there is no danger that the steam cools and condenses.

In accordance with a particularly preferred feature, an inlet valve each is arranged in the area of each end of the distribution duct. In some cases, more space is available in the areas of the ends than in the middle of the steam moistening apparatus. Since two inlet valves are used, a relatively uniform steam distribution can be achieved.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DETAILED DESCRIPTION OF THE PREFERRED EMBODIMENTS

Figure 1:
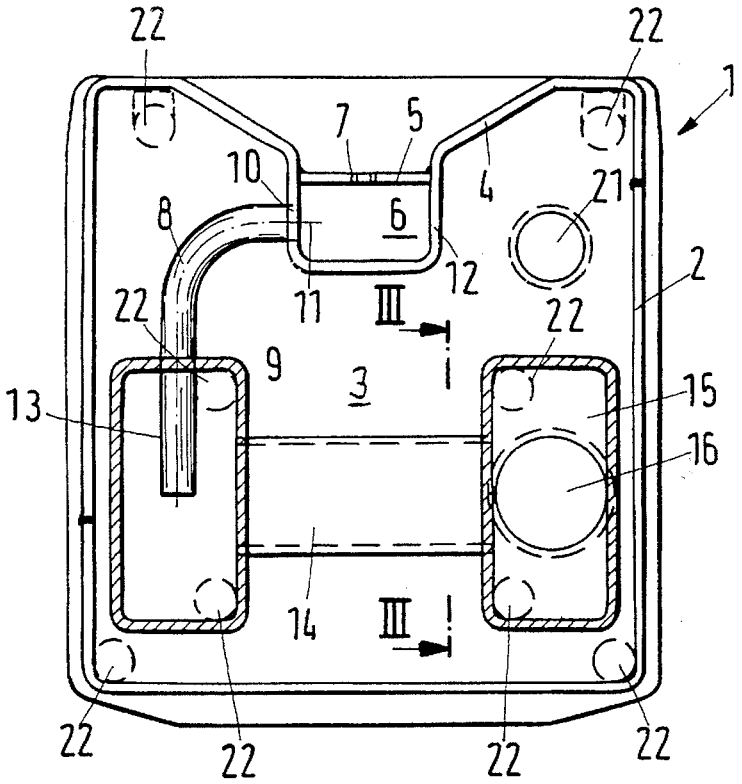
FIG. 1 is a cross-sectional view of a first embodiment of a steam moistening apparatus according to the present invention.

As illustrated in FIG. 1 of the drawing, a steam moistening apparatus 1 has a housing 2 with an interior space 3. A U-shaped housing wall 4 is integrally formed in the interior space 3. Together with a diffusor plate 5, the housing wall 4 forms a steam blow chamber 6. The diffusor plate 5 has a plurality of steam outlet openings 7.

The steam blow chamber 6 is connected to a distribution duct 9 through a plurality of supply lines 8. Each supply line 8 extends with its opening 10 into the steam blow chamber 6 in such a way that the axis 11 of the opening 10 extends essentially at a right angle to an opposite wall of the steam blow chamber 6, wherein this opposite wall will be called a baffle wall 12 in the following. The baffle wall 12, in turn, extends at a right angle to the diffusor plate 5.

The supply line 8 extends with a certain length 13 into the interior of the distribution duct 9. Accordingly, steam can reach the supply line 8 only from the interior of the distribution duct 9. Any water which may precipitate at the walls of the distribution duct 9 is prevented from entering the supply line 8.

Figure 2:
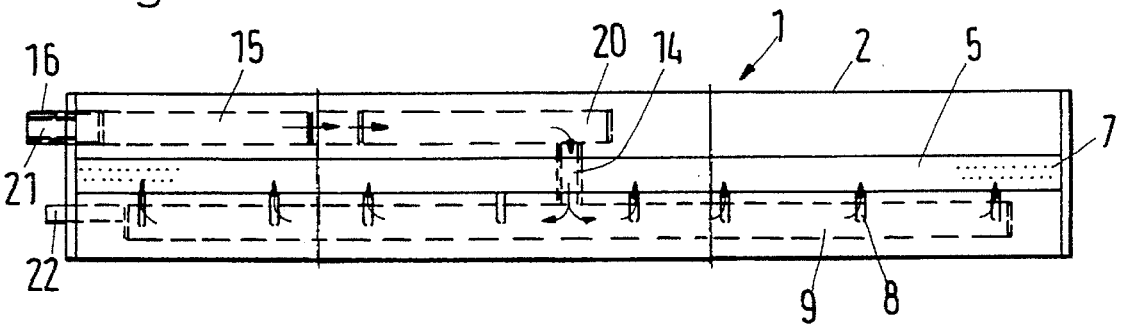
FIG. 2 is a top view of the steam moistening apparatus of FIG. 1.

As particularly illustrated in FIG. 2, the distribution duct 9 is connected to an inlet duct 15 through a connecting duct 14 which forms a steam inlet. The inlet duct 15 has a process steam connection 16 through which steam, which is to be used for moistening a material web, not shown, is supplied to the inlet duct 15. The inlet duct 15 is constructed as a steam drying section. The drying of steam is achieved by two measures. First, the cross-sectional area of the inlet duct 15 is substantially greater than the cross-sectional area of the process steam connection 16. This means that the flow velocity of the steam in the inlet duct is reduced as compared to the flow velocity of the steam in the process steam connection 16, so that any water entrained in the steam can drop down. In addition, intermediate walls 17 with openings 18 are provided in the inlet duct, wherein the intermediate walls 17 force the steam to change its direction, as indicated by arrows 19. The steam can carry out the changes of direction in accordance with arrows 19 essentially without problems. However, any entrained water has the tendency to travel straight ahead because of its greater inertia. The water impinges on the walls 17 and flows down on the walls 17 in the direction of gravity. A possibility for draining the water may be provided at each intermediate wall 17. For example, the water may be drained by means of a siphon. However, it is also possible alternatively to collect the water flowing down at all walls 17 and to discharge this water.

As an additional measure for drying the steam it may be provided that the connecting duct 14 branches off at a certain distance in front of the end of the inlet duct 15. The connecting duct 14 may branch off essentially at a right angle. As a result, the inlet duct 15 forms at its end a kind of pocket 20 in which remaining water droplets can be collected. A means for discharging the water may be provided in the pocket 20.

The housing 2 further includes a heating steam connection 21 through which steam can be admitted into the interior space 3 of the housing 2. Depending on the pressure at the heating steam connection 21 and, thus, depending on the pressure of the steam in the interior space 3 of the housing 2, a certain temperature will prevail in the interior space 3. Consequently, the steam contained in the interior space 3 of the housing 2 heats the inlet duct 15 as well as the distribution duct 19. In addition, the supply lines 8 and the three walls of the steam blow chamber 6 are heated by the heating steam. Accordingly, even if water droplets travel through the process steam connection 16 into the inlet duct 15, the connecting duct 41, the distribution duct 9, the supply lines 8 or the steam blow chamber 6, it is very likely that the water droplets evaporate. The likelihood that water is still contained in the steam decreases with increasing travel towards the steam blow chamber 6. As a result, the likelihood that water is still in the steam in the steam blow chamber is practically zero. Any water droplets which nevertheless have travelled all the way into the steam blow chamber 6 are initially directed against the heated baffle wall 12, where they can evaporate. If they do not evaporate, they are reflected back into the arriving steam jet. As a result of the configuration illustrated in the drawing, the time the water droplets remain in the steam blow chamber 6 can be increased to such an extent that the water droplets will evaporate in the steam blow chamber 6 with a likelihood which borders on certainty and cannot be discharged through the openings 7 of the diffusor plate 5.

The distribution duct 9 has a cross-sectional area which is greater than the sum of the cross-sectional areas of all supply lines 8. As a result, a relatively uniform steam pressure will build up in the distribution duct 9, wherein this pressure is no longer dependent on the distance from the connecting duct 14. This dependency is further decreased as a result of the fact that the maximum distance of a supply line 8 from the connecting duct 14 corresponds to half the length of the distribution duct 9. This means that the distance which must be travelled by the steam from the connecting duct 14 to the supply line 8 which is farthest away, is kept as short as possible.

Since the inlet duct 15 extends approximately into the middle of the distribution duct 9, the steam must travel half the width of the steam moistening apparatus 1 before it can enter the distribution duct 9. However, this entire section is already heated, so that any water still contained in the steam can evaporate. Any additional water which still has not been evaporated or which has been separated by the intermediate walls 17 can then evaporate in the distribution duct 9.

The drawing schematically shows a plurality of drainage openings 22. However, such drainage openings are known in connection with steam blow boxes. The openings 22 may be connected, for example, to a siphon or an appropriate valve for allowing water to be discharged without loss of pressure.

A steam moistening apparatus 1 of this type can be operated with a remote valve, not shown, which controls the total steam discharge by the steam moistening apparatus 1. When the valve is closed, for example, during an interruption of production, the line between this valve which is not illustrated and the steam moistening apparatus 1 will cool down. The steam contained in the apparatus will condense. When the steam moistening apparatus 1 is restarted, the corresponding quantity of water, for example, 0.5 or 1 l, will reach the inlet duct 15. Since the inlet duct 15 is constructed as a steam drying section, the water will be already essentially removed in this section, partially by mechanical measures, such as, the intermediate walls 17 and the pocket 20, and partially by heating. Any water still remaining will then evaporate in the distribution duct 9 which is heated over its full circumference.

Figure 3:
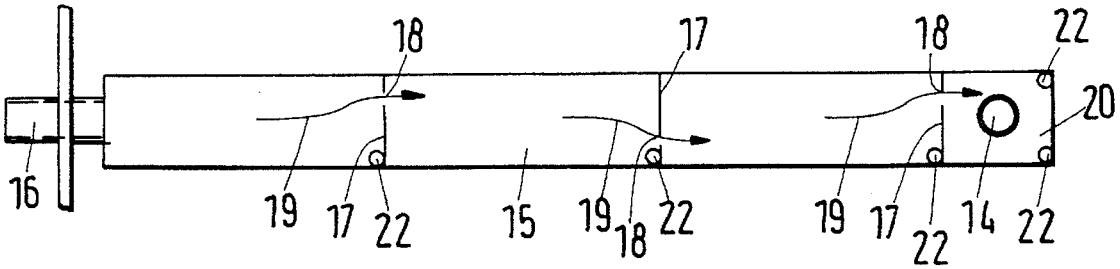
FIG. 3 is a partial sectional view taken along sectional line III—III of FIG. 1.
Figure 4:
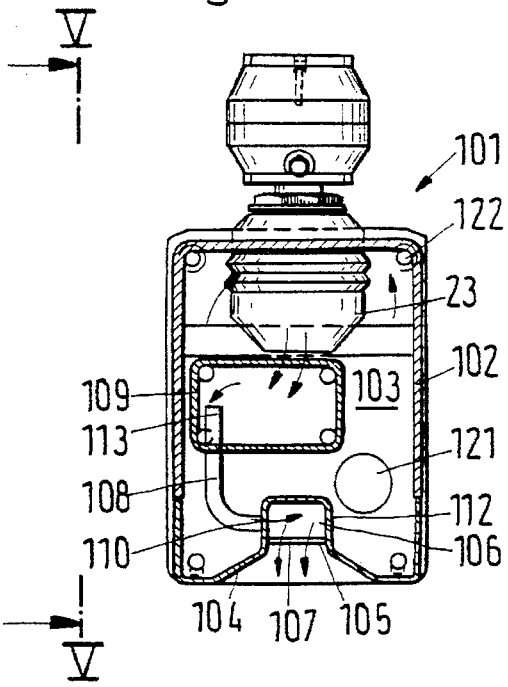
FIG. 4 is a cross-sectional view of a second embodiment of the steam moistening apparatus according to the present invention.
Figure 5:
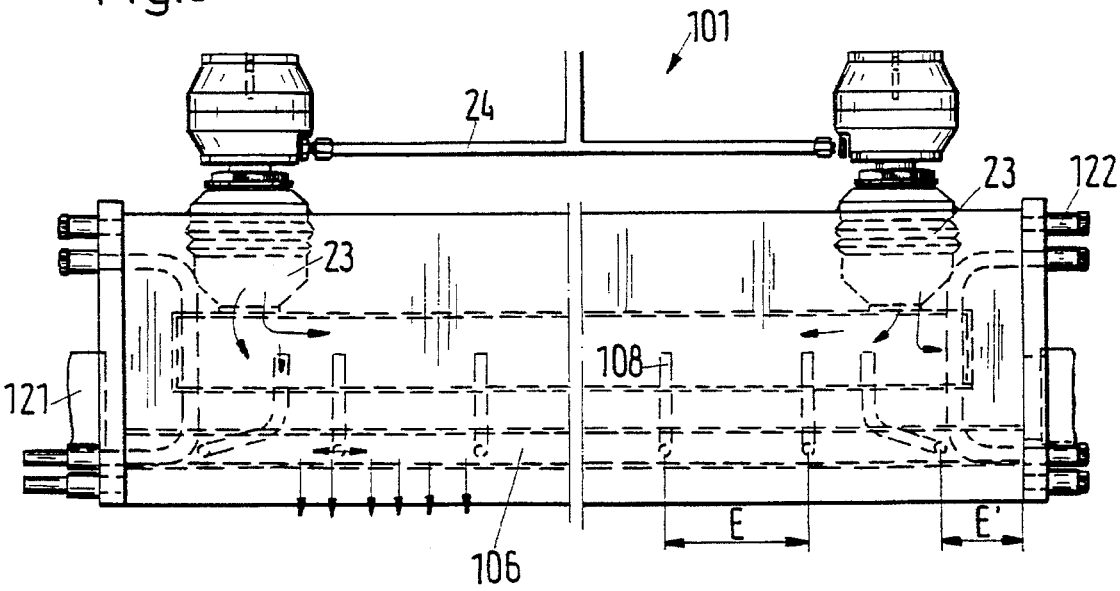
FIG. 5 is a view according to V—V of FIG. 4.

FIGS. 4 and 5 show another embodiment of the steam moistening apparatus according to the present invention, wherein corresponding components are provided with the same reference numerals except that they are increased by 100. Any components which are the same as in the embodiment shown in FIGS. 1–3 will not be discussed once again.

Contrary to the embodiment of FIGS. 1–3, the steam moistening apparatus 101 is arranged in such a way that the steam is discharged downwardly in the direction of gravity. Consequently, the diffusor plate 105 which forms the outer wall of the housing 102 in this area is arranged at the bottom in the direction of gravity. Also, the supply line 108 opens into the distribution duct 109 in a downward direction. Even if water is collected in the distribution duct 109, this water cannot flow into the steam blow chamber 106 because the end 113 of the supply line 108 extends into the distribution duct 109.

In this embodiment, the distribution duct 109 does not have a separate process steam connection. Rather, only a single steam connection 121 is provided for supplying steam to the interior space 103 of the housing 102.

Two valves 23 are provided for supplying steam to the distribution duct 109. The steam-conducting components of the valves are arranged in the interior space 103 of the housing 102. The valves 23 form inlet valves for the distribution duct 109, i.e., the valves 23 control the steam supply from the interior space 103 of the housing 102 into the distribution duct 109. However, also in this case, the distribution duct 109 is surrounded by steam permanently and over its full circumference. The flow path of the steam is indicated by arrows.

In this embodiment illustrated in FIGS. 4 and 5, the valves 23 are arranged in the areas of the two ends of the distribution duct 109. Consequently, also in this case, the maximum distance from the entry into the distribution duct 109 to the farthest remote supply line 108 corresponds to half the length of the distribution duct 109.

As is apparent from FIG. 5, the distances E between adjacent openings of the supply lines 108 into the steam blow chamber 106 are essentially equal. The distance E' between the supply line 108 which is located closest to the end of the steam blow chamber 106 corresponds approximately to half the distance E. Accordingly, the individual supply lines 108 all open into the steam blow chamber 106 in the center of imaginary zones, wherein, however, the steam blow chamber 106 is not actually divided into zones and the zones cannot be controlled individually.

Figure 6:
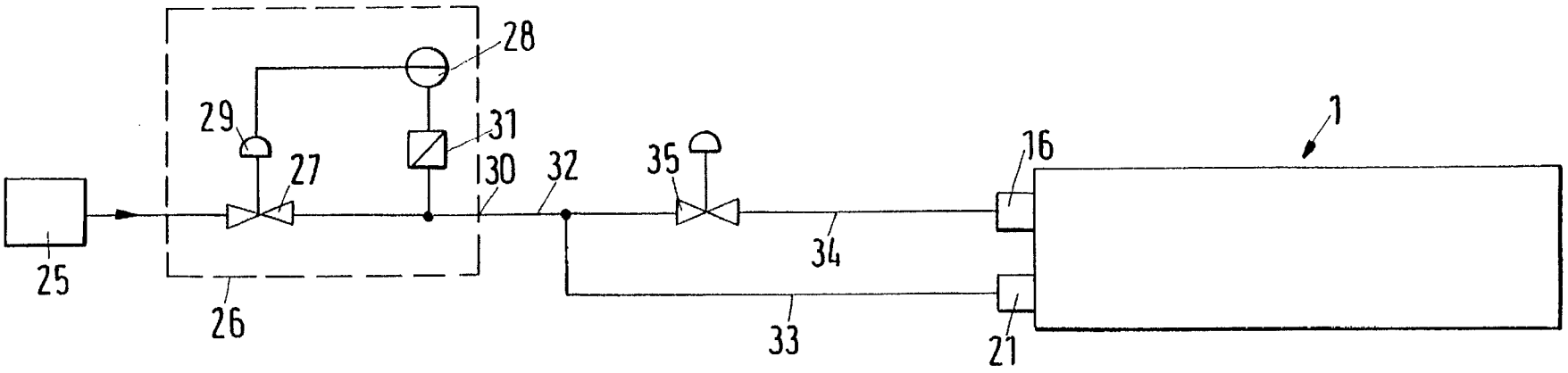
FIG. 6 is a diagram showing the steam flow in the first embodiment of the steam moistening apparatus.

FIG. 6 schematically shows the path of the steam from a steam source 25 to the steam moistening apparatus 1. A pressure regulator 26 is arranged following the steam source 25, for example, a steam boiler; the pressure regulator 26 is provided in the conventional manner with a valve 27 which keeps constant the pressure at the output 30 of the pressure regulator 26 through a drive 29 controlled by a regulator 28. The regulator or convertor 28 obtains its measurement values through a sensor 31.

The steam line 32 is divided following the pressure regulator 26. One branch 33 is connected directly to the heating steam connection 21 of the steam moistening apparatus 1. Accordingly, at the heating steam connection 21, steam is permanently present at a temperature determined by the pressure regulator 26.

Another branch 34 of the steam line 32 is connected to the process steam connection 16. A valve 35 is arranged in this branch 34, wherein the valve 35 controls the supply of process steam, i.e., the quantity of the steam to be conducted against the material web.

Figure 7:
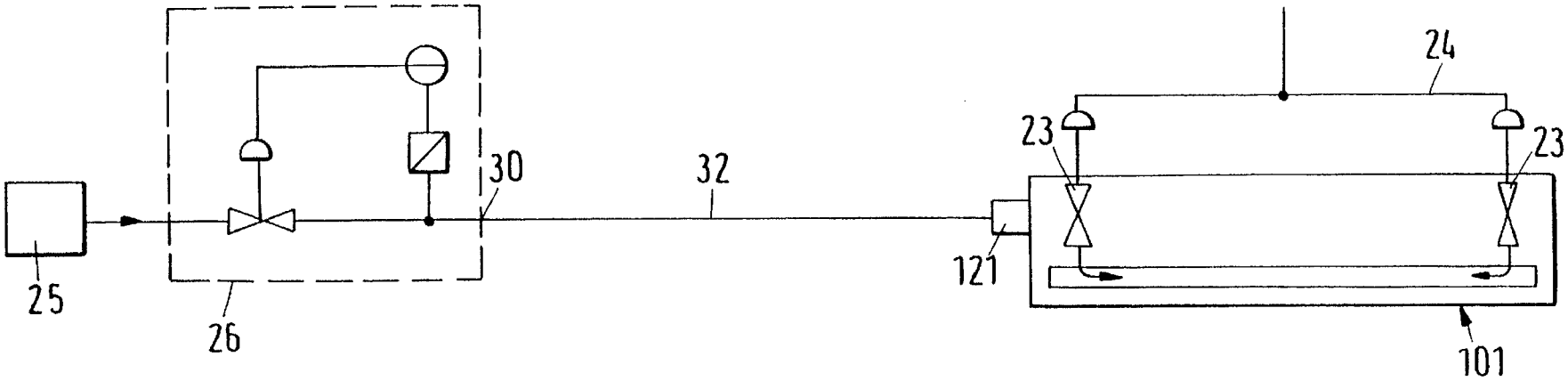
FIG. 7 is a diagram showing the steam flow in the second embodiment of the steam moistening apparatus.

FIG. 7 schematically illustrates the path of the steam in the embodiment of the apparatus 101 shown in FIGS. 4 and 5. A steam source 25 is provided also in this embodiment with a pressure regulator 26 downstream of the pressure source 25. The output 30 of the pressure regulator is connected through the steam line 32 directly to the heating steam connection 121 of the steam moistening apparatus 101. As shown in FIGS. 4 and 5, the steam conducted through the connection 121 is supplied to the steam blow chamber 106 through the valves 23 which are both connected through a common line 24.

The valves 23, 25 are constructed as self-closing valves, for example, as spring-closing valves, wherein the valves remain closed unless an appropriate control force is applied. The valves are preferably linear valves in which the quantity of steam passing through the valves is in a linear relationship to the regulating signal for the valves 23, 25.

The invention is not limited by the embodiments described above which are presented as examples only but can be modified in various ways within the scope of protection defined by the appended patent claims.

I claim:

1. A steam moistening apparatus comprising a housing having an interior space and a length, a steam blow chamber being mounted in the housing, the housing and the steam blow chamber having a common external wall, the external wall being provided with steam outlet openings, the housing further having means for admitting steam into the interior space of the housing, a distribution duct being mounted in the interior of the housing so as to be continuously surrounded by steam on all sides thereof, further comprising means for admitting steam to the distribution duct, and a plurality of supply lines for connecting the distribution duct to the steam blow chamber, wherein the supply lines are distributed over the length of the housing.

2. The steam moistening apparatus according to claim 1, wherein the distribution duct and the supply lines each have a cross-sectional area, and wherein the cross-sectional area of the distribution duct is greater than a sum of the cross-sectional areas of all supply lines.

3. The steam moistening apparatus according to claim 1, wherein each supply line has an opening into the steam blow chamber, the steam blow chamber further comprising a baffle wall located opposite the openings of the supply lines, each supply line having an axis extending essentially perpendicularly to the baffle wall.

4. The steam moistening apparatus according to claim 3, wherein the baffle wall extends essentially at a right angle to the external wall.

5. The steam moistening apparatus according to claim 1, wherein the distribution duct has an interior, the supply lines extending with a length into the interior of the distribution duct.

6. The steam moistening apparatus according to claim 1, wherein each supply line has a bend between the distribution duct and the steam blow chamber, wherein the bend extends over an angle of approximately 90°.

7. The steam moistening apparatus according to claim 3, wherein the openings of the supply lines into the steam blow chamber are spaced apart at approximately equal distances.

8. The steam moistening apparatus according to claim 1, wherein the distribution duct has a length, and wherein a maximum distance of the supply lines from the means for admitting steam to the distribution duct corresponds to half the length of the distribution duct.

9. The steam moistening apparatus according to claim 1, wherein the means for admitting steam to the housing is separate from the means for admitting steam to the distribution duct.

10. The steam moistening apparatus according to claim 9, wherein the means for admitting steam into the interior of the housing comprises an inlet duct, the inlet duct having a middle, further comprising a connecting duct for connecting the inlet duct to the distribution duct, and wherein the connecting duct is located approximately in the middle of the distribution duct.

11. The steam moistening apparatus according to claim 10, wherein the inlet duct comprises a steam drying section.

12. The steam moistening apparatus according to claim 10, wherein the connecting duct extends essentially at a right angle relative to the inlet duct, the inlet duct having an end, wherein the connecting duct is located at a distance in front of the end of the inlet duct.

13. The steam moistening apparatus according to claim 1, wherein the distribution duct comprises at least one inlet valve, the inlet valve having steam-conducting components, wherein the steam-conducting components are mounted in the interior of the housing, whereby steam is conducted through the inlet valve from the interior of the housing into the distribution duct.

14. The steam moistening apparatus according to claim 13, wherein the distribution duct has ends, wherein an inlet valve each is mounted at the ends of the distribution duct.

15. A steam moistening apparatus comprising a housing having an interior space and a length, a steam blow chamber being mounted in the housing, the housing and the steam blow chamber having a common external wall the external wall being provided with steam outlet opening, the housing further having means for admitting steam into the interior space of the housing, a distribution duct being mounted in the interior of the housing so as to be continuously surrounded by steam on all sides thereof, further comprising means for admitting steam to the distribution duct, and a plurality of supply lines for connecting the distribution duct to the steam blow chamber, wherein the supply lines are distributed over the length of the housing wherein each supply line has an opening into the steam blow chamber, the steam blow chamber further comprising a baffle wall located opposite the openings of the supply lines, each supply line having an axis extending essentially perpendicularly to the baffle wall, wherein the openings of the supply lines into the steam blow chamber are spaced apart at approximately equal distances, wherein the steam blow chamber has ends, and wherein a distance between each end of the steam blow chamber and an adjacent supply line opening is approximately half the distance between adjacent openings of supply lines.

16. A steam moistening apparatus comprising a housing having an interior space and a length, a steam blow chamber being mounted in the housing, the housing and the steam blow chamber having a common external wall, the external wall being provided with steam outlet openings, the housing further having means for admitting steam into the interior space of the housing, a distribution duct being mounted in the interior of the housing so as to be continuously surrounded by steam on all sides thereof, further comprising means for admitting steam to the distribution duct, and a plurality of supply lines for connecting the distribution duct to the steam blow chamber, wherein the supply lines are distributed over the length of the housing, wherein the means for admitting steam to the housing is separate from the means for admitting steam to the distribution duct, wherein the means for admitting steam into the interior of the housing comprises an inlet duct, the inlet duct having a middle, further comprising a connecting duct for connecting the inlet duct to the distribution duct, wherein the inlet duct comprises a steam drying section, wherein the connecting duct is located approximately in the middle of the distribution duct, and wherein the inlet duct comprises at least one means for changing a direction of the flow of the steam.

* * * * *